US005195882A

United States Patent [19]

Freeman

[11] Patent Number: 5,195,882

[45] Date of Patent: Mar. 23, 1993

[54] GEROTOR PUMP HAVING SPIRAL LOBES

[75] Inventor: Richard R. Freeman, Alcester, Great Britain

[73] Assignee: Concentric Pumps Limited, United Kingdom

[21] Appl. No.: 925,319

[22] Filed: Aug. 4, 1992

Related U.S. Application Data

[63] Continuation of Ser. No. 697,803, May 9, 1991, abandoned.

[30] Foreign Application Priority Data

May 12, 1990 [GB] United Kingdom ..... 9010686

[51] Int. Cl.[5] ..... F04C 2/107

[52] U.S. Cl. ..... 418/171; 418/201.1

[58] Field of Search ..... 418/166, 170, 171, 201.1

[56] References Cited

U.S. PATENT DOCUMENTS

| | | | |
|---|---|---|---|
| 1,768,818 | 7/1930 | Bock | 418/170 |
| 1,780,338 | 11/1930 | Canton | 418/201.1 |
| 2,211,154 | 8/1940 | Oshei | 418/201.1 |
| 2,349,022 | 5/1944 | Ungar et al. | 418/170 |
| 2,462,924 | 3/1949 | Ungar | 418/197 |
| 2,830,542 | 4/1958 | Erickson et al. | 418/171 |
| 3,822,972 | 7/1974 | Ogly et al. | 418/48 |
| 4,424,013 | 1/1984 | Bauman | 418/61.3 |
| 4,711,006 | 12/1987 | Baldenko et al. | 418/48 |
| 4,863,357 | 9/1989 | Olofsson | 418/48 |
| 5,056,995 | 10/1991 | Tamura et al. | 418/201.1 |

FOREIGN PATENT DOCUMENTS

| | | | |
|---|---|---|---|
| 55-46077 | 3/1980 | Japan | 418/171 |
| 2022708 | 12/1979 | United Kingdom | 418/166 |
| WO85-4215 | 9/1985 | World Int. Prop. O. | 418/197 |

*Primary Examiner*—John J. Vrablik
*Attorney, Agent, or Firm*—Learman & McCulloch

[57] ABSTRACT

A gerotor pump has a rotatable, lobed rotor with n lobes meshed with a rotable lobed annulus with n+1 lobes, the two being conjointly and relatively rotatable about parallel axes. The lobes of both the rotor and the annulus spiral helically to smooth pressure peaks and reduce noise.

10 Claims, 2 Drawing Sheets

GEROTOR PUMP HAVING SPIRAL LOBES

This is a continuation of copending application Ser. No. 07/697,803 filed on May 9, 1991, abandoned.

BACKGROUND OF THE INVENTION

This invention relates to gerotor devices which comprise a rotor having n lobes and which is located eccentrically and internally of a lobed annulus having a larger number of lobes (e.g. n+1). These parts form a series of chambers each bounded by lines of contact between the respective parts, and of different volumes: adjacent to a position where one rotor lobe is fully meshed between two annulus lobes the chambers are minimal, and at an approximately diametric position, (according to whether the rotor has an odd or even number of lobes) the chamber is maximal. When the rotor is rotated relative to the annulus the individual chambers vary in volume.

It is known from U.S. Pat. No. 4,863,357 to make both stator (a stationary annulus) and rotor conical, with variable pitch spiralling lobes which result in constant axial length chambers which however reduce in volume due to the reduced lobe height along the cones. This is to be used as a fluid compressor with flow essentially along the axis from the large end to the small end of the cone. Such a compressor requires a substantial axial length.

It is also known to make down-hole motors, that is axial flow pumps using the tubular stator with a spirally multiple-start internal thread, meshed with a generally cylindrical rotor having a multiple-start male thread differing in start number. Again the axial length is an important factor in pump output and flow is essentially along the axis from one end to the other.

Many gerotor designs are used as i.c. engine lubrication pumps in situations where compact axial dimensions are important and sometimes the inlet and outlet are to be at the same axial end. The spiralling arrangements with axial flow through the pump are then unsuitable for both reasons and the conventional arrangement for such pumps is to use a rotor and annulus which are both prismatic and moreover mount the annulus for rotation at a different speed to that of the rotor so that it is no longer a stator, which avoids the need for a wobble stick type drive. In such an arrangement there is a pulsating pressure output which can be part-smoothed by providing an outlet port extending over a substantial arcuate segment so that a series of such chambers is exposed to the outlet port.

There is a necessary clearance between the parts in a radial direction for example but not exclusively as so-called dirt clearance, but this is as small as possible to avoid leakage from high pressure chambers to lower pressure chambers, and ideally every chamber is always bounded by two lines of contact between the annulus and rotor.

There are two specific problems with pumps of this kind namely noise and pressure fluctuation or ripple. The former, noise, is due to clearance being taken up especially as the chambers go from the inlet side to the outlet side and vice versa, so that in practice as each rotor lobe moves to the lowest pressure position it tends to hammer on the annulus. The second problem is due to the succession of chambers moving into register with the ports and the pressure ripple is of greatest amplitude and lowest frequency with smaller values of n (and vice versa).

The object of the invention is to provide improvements.

SUMMARY OF THE INVENTION

According to the invention, a gerotor pump set comprises an annulus and rotor with different lobe numbers, both rotatable but relative to one another on parallel axes, and with fixed inlet and outlet ports provided in a pump body housing the set and at one and the same axial end of the set, and is characterised in that the lobes of both parts spiral helically along their length.

The angle of inclination of the helix will depend upon other parameters including axial length of the gerotor set, and in general the helix will be such as to locate one axial end of each inter-lobe chamber no more than a small fraction of one lobe out of phase with the opposite end.

It is however within the scope of the invention to provide either the inlet or the outlet port at both ends of the pump, for example using an external passage linking the two ends and connected to the inlet or outlet. This is particularly useful in the case of the inlet side rather than the outlet because of the general difficulty in obtaining good chamber filling without cavitation. Usually it is considered unnecessary to duplicate the outlet ports at both axial ends because there is less difficulty on the high pressure side of the pump. However there may be advantage with the present invention in such a duplication on the outlet side because, as will be appreciated, the ports if provided at both ends and axially (not helically) aligned will consequently be registered with different chambers at any one time. Hence the pressure ripple will be smoothed because one chamber in the highest pressure position will deliver to first one, then both, then the other of the respective outlet ports, and at the first and third of these times other chambers will also be in the highest pressure/delivery position and will also be delivering to the outlet. So the pressure fluctuation will be reduced and smoothed.

Most significantly, the invention is believed to reduce noise because, instead of the full width of one lobe hammering on the other the highest pressure point will roll helically and travel axially, thus spreading the time value in like fashion.

THE DRAWINGS

The invention is now more particularly described with reference to the accompanying drawings wherein.

DETAILED DESCRIPTION

Figure 1:
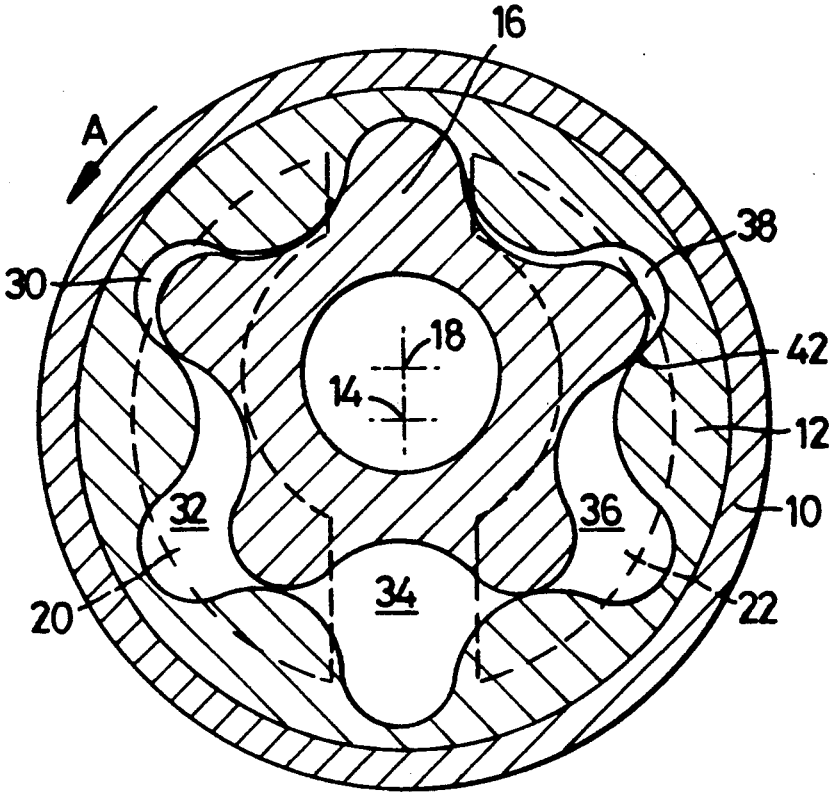
FIG. 1 is a sectional elevation of a typical gerotor pump.
Figure 2:
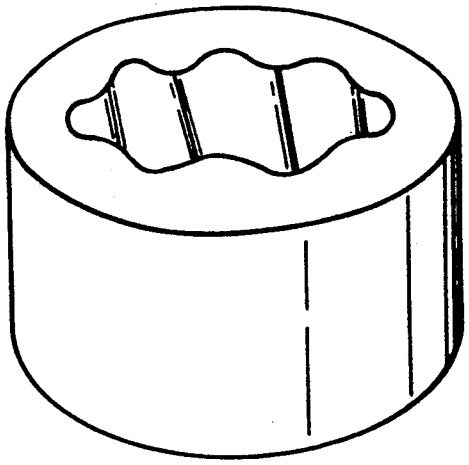
FIG. 2 is a perspective view of the annulus of said pump.

Turning first to FIG. 1 the pump comprises a body 10 having a cylindrical cavity between two end walls and in which is journaled an annulus 12 for rotation about axis 14. Rotor 16 is mounted to turn on axis 18. In the illustrative example the rotor has five lobes and the annulus six. One or other of the rotor and annulus is driven by means not shown for example a shaft projecting axially, and the rotation is transferred to the other of the rotor set but at a different speed.

At one end of the cavity is a conventional end wall (not shown) and at the opposite end is an end wall having inlet and outlet ports formed therein as shown by dotted lines. Assuming the direction of rotation to be in that of the arrow A, port 20 is the inlet and port 22 is the outlet. As is shown clearly in FIG. 1, each of the ports 20 and 22 is of corresponding curvilinear configuration and each has a corresponding arcuate length of less than 180°. The ports are symmetrical about a plane containing the axes of rotation of the annulus and the rotor. Thus, the area of the inlet port 20 increases in the direction of rotation of the annulus and the rotor, and the area of the outlet port 22 decreases in such direction of rotation. The confronting ends of the ports are uniformly spaced from one another.

A series of pumping chambers 30, 32, 34, 36 and 38 is formed between the parts. The number of chambers is equal to the number of rotor lobes. As the gerotor turns, chamber 30 expands in volume in the first half of its rotation as it goes through the positions of 32, 34 and then decreases in volume in the second half of rotation as it goes through the positions 36 and 38. During the expansion time, fluid is induced into the pump, and during the contraction time, fluid is expressed out of the pump, through the respective ports.

The outlet pressure expressed graphically against the rotation cycle will be seen to be maximal when the chamber 38 sweeps over the final portion (in the direction of rotation) of the outlet port 22, becoming minimal as the line of contact 42 between the rotor and the annulus, at the trailing end of the chamber 38, passes that point. Pressure increases again to a maximum and then falls to the minimum when the next contact line passes the point. This is the source of the ripple effect mentioned earlier herein.

The pump as described so far in connection with FIG. 1 is conventional and typical in several ways of the prior art. In such prior art pumps, both the rotor and annulus are prismatic, having identical shape and dimension for their opposite axial ends, and with points on the periphery at each end connected by straight lines lying in planes essentially containing the axis of rotation of the part.

According to the invention both annulus and rotor are non-prismatic and whilst having like end faces are spiralled at one and the same helix angle for both components. Thus FIG. 1 could be a cross section taken on any point along the axis 18.

Figure 3:
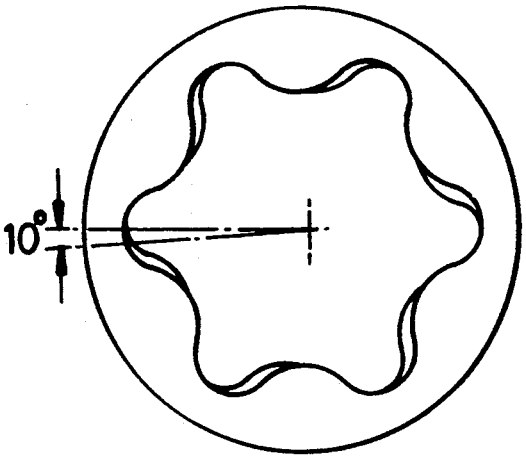
FIG. 3 is a plan view of said annulus.
Figure 4:
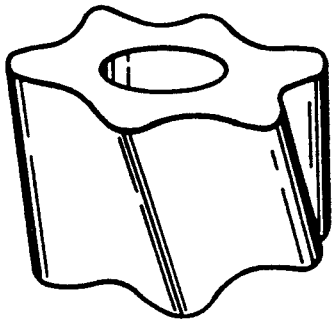
FIGS. 4 and 5 are views similar to FIGS. 2 and 3 showing the rotor of said pump.
Figure 5:
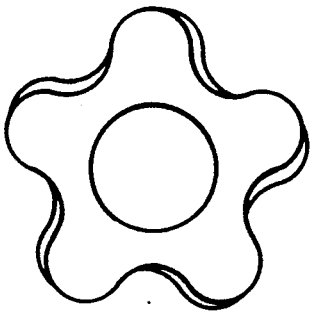
Figure 6:
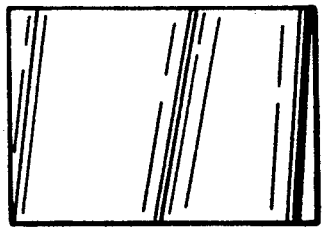
FIG. 6 is a side elevation of said rotor.

The selected helix angle in relation to axial length of the components is such as to provide a small fraction of the helix angle necessary if a complete phase change were required. Thus for a six lobed annulus, a 60 deg. helix turn would bring about one phase change. In the illustration about 10 deg. is employed as indicated on FIG. 3. Values of this order and within the range 5–15 deg. are preferred but other angles are possible.

The effect of the helicity may be considered thus: the highest pressure chamber 38 in effect extends circumferentially for (in the case of the illustrative example) 10 deg. So that during passage of this chamber through the zone before the following sealing line cuts off delivery, high pressure fluid can be delivered over a more widely distributed portion of the revolution cycle than in the prior art. This brings about the smoothing effect.

The noise reduction phenomena needs a more complex explanation, but simply expressed is due to the pressure smoothing. Each pressure peak in the fluid applies an equal and opposite reaction to the rotating parts, so that if the pressure peak is distributed over 10 deg. of arc instead of near instantaneously, the minimised mechanical reaction of the pump components avoids or reduces noise generation correspondingly.

I claim:

1. A gerotor pump comprising a body having a cylindrical cavity therein between a pair of end walls; an annulus having n+1 internally projecting lobes accommodated in said cavity for rotation about a first axis; a rotor accommodated in said cavity for rotation about a second axis parallel to said first axis and having n externally projecting lobes in mesh with all n+1 lobes of said annulus and forming a series of pumping chambers in an orbital path about said axes between said rotor and said annulus, said chambers increasing in volume in the first half of said orbital path and decreasing in volume in the second half of said orbital path; an arcuate inlet port in one of said end walls in axial communication with said increasing volume chambers and having an arcuate length less than 180°; and an arcuate outlet port in one of said end walls in axial communication with said decreasing volume chambers and having an arcuate length less than 180°, thereby enabling fluid to be drawn axially into the increasing volume chambers via said inlet port, travel orbitally about said axes into the decreasing volume chambers, and then exhaust axially via said outlet port, the lobes of each of said annulus and said rotor spiraling helically along their length through a fraction of a revolution which is such that one end of each of said lobes is between 5° and 15° out of phase with its opposite end.

2. The pump according to claim 1 wherein said inlet port and said outlet port are in the same end wall.

3. The pump according to claim 1 wherein said inlet port has an increasing area in the direction of rotation of said annulus and said rotor.

4. The pump according to claim 1 wherein said outlet port has a decreasing area in the direction of rotation of said annulus and said rotor.

5. The pump according to claim 1 wherein said inlet port has an increasing area in the direction of rotation of said annulus and said rotor and wherein said outlet port has a decreasing area in said direction of rotation.

6. The pump according to claim 1 wherein said inlet port and said outlet port are substantially uniform in length.

7. The pump according to claim 1 wherein each of said inlet and outlet ports has a leading end and a trailing end, the leading end of said inlet port being spaced from the trailing end of said outlet port and the trailing end of said inlet port being spaced from the leading end of said outlet port a distance corresponding substantially to that of the space between the trailing and leading ends of said outlet and inlet ports.

8. The pump according to claim 1 wherein the helical angle at which said lobes spiral is such that one end of each of said lobes is about 10° out of phase with its opposite end.

9. The pump according to claim 1 wherein said inlet and outlet ports are symmetrical about a plane containing the axes of rotation of said annulus and said rotor.

10. A gerotor pump comprising a body having a cylindrical cavity therein between a pair of end walls; an annulus having n+1 internally projecting lobes accommodated in said cavity for rotation about a first axis; a rotor accommodated in said cavity for rotation about a second axis parallel to said first axis and having n externally projecting lobes in mesh with all n+1 lobes of said annulus and forming a series of pumping chambers in an orbital path about said axes between said rotor and said annulus, said chambers increasing in volume in the first half of said orbital path and decreasing in volume in the second half of said orbital path; an arcuate inlet port in one of said end walls in axial communication with said increasing volume chambers and having an arcuate length less than 180°; and an arcuate outlet port in said one of said end walls in axial communication with said decreasing volume chambers and having an arcuate length less than 180°, thereby enabling fluid to be drawn axially into the increasing volume chambers via said inlet port, travel orbitally about said axes into the decreasing volume chambers, and then exhaust axially via said outlet port, the area of said inlet port increasing in the direction of rotation of said rotor and said annulus and the area of said outlet port decreasing in said direction of rotation, said inlet and outlet ports being symmetrical about a plane containing the axes of rotation of said annulus and said rotor, the lobes of each of said annulus and said rotor spiraling helically along their length through a fraction of a revolution which is such that one end of each of said lobes is between 5° and 15° out of phase with its opposite end.

* * * * *